US007992365B2

(12) United States Patent
Uebel et al.

(10) Patent No.: US 7,992,365 B2
(45) Date of Patent: Aug. 9, 2011

(54) DEVICES AND METHODS FOR VERIFYING CAPPING OF VIALS IN SYSTEM FOR DISPENSING PRESCRIPTIONS

(75) Inventors: Mark Alan Uebel, Morrisville, NC (US); James Robert Rivenbark, Jr., Raleigh, NC (US); Jasper Pollard, Durham, NC (US); John Richard Sink, Raleigh, NC (US); Demetris P. Young, Durham, NC (US); Tobias Heineck, Durham, NC (US)

(73) Assignee: Parata Systems, LLC, Durham, NC (US)

( * ) Notice: Subject to any disclaimer, the term of this patent is extended or adjusted under 35 U.S.C. 154(b) by 192 days.

(21) Appl. No.: 12/350,461

(22) Filed: Jan. 8, 2009

(65) Prior Publication Data

US 2009/0178370 A1 Jul. 16, 2009

Related U.S. Application Data

(60) Provisional application No. 61/020,412, filed on Jan. 11, 2008.

(51) Int. Cl.
*B67B 3/20* (2006.01)

(52) U.S. Cl. ..... 53/490; 53/484; 53/317; 53/334

(58) Field of Classification Search ..... 53/287, 53/301, 308, 317, 329, 331.5, 334, 490, 484, 53/485

See application file for complete search history.

(56) References Cited

U.S. PATENT DOCUMENTS

| | | | | |
|---|---|---|---|---|
| 2,689,647 | A | 9/1954 | Hofstetter et al. | |
| 3,831,344 | A * | 8/1974 | Over | 53/329 |
| 4,535,583 | A * | 8/1985 | Tanaka et al. | 53/75 |
| 4,614,077 | A * | 9/1986 | Muto et al. | 53/490 |
| 4,616,466 | A * | 10/1986 | Tanaka et al. | 53/75 |
| 4,696,144 | A * | 9/1987 | Bankuty et al. | 53/331.5 |
| 5,321,935 | A * | 6/1994 | Spatz et al. | 53/490 |
| 5,398,480 | A * | 3/1995 | Bankuty | 53/315 |
| 5,419,094 | A * | 5/1995 | Vander Bush et al. | 53/75 |
| 5,437,139 | A * | 8/1995 | Martin | 53/317 |
| 5,718,097 | A * | 2/1998 | Kinoshita et al. | 53/75 |
| 5,996,311 | A * | 12/1999 | Heard et al. | 53/317 |

(Continued)

FOREIGN PATENT DOCUMENTS

DE 199 46 951 A1 4/2001

(Continued)

OTHER PUBLICATIONS

The International Search Report and Written Opinion of PCT/US2009/000097 dated Mar. 25, 2009.

*Primary Examiner* — Paul R Durand
(74) *Attorney, Agent, or Firm* — Myers Bigel Sibley Sajovec

(57) ABSTRACT

A method of verifying the seating and securing of a closure on a container includes the steps of: (a) positioning a container on a stage of an automated capping station; (b) bringing a closure into contact with the container; (c) detecting the nature of a physical relationship between the container and the closure; (d) responsive to step (c), relatively moving the closure and the container if step (c) indicates seating of the closure on the container is proper; and (e) detecting the nature of a physical relationship between the closure and the container to determine whether the closure is properly secured.

16 Claims, 16 Drawing Sheets

U.S. PATENT DOCUMENTS

| | | | | |
|---|---|---|---|---|
| 6,058,760 | A * | 5/2000 | Van Heyningen | 73/1.79 |
| 6,410,909 | B1 * | 6/2002 | Rudolph et al. | 250/231.13 |
| 6,525,498 | B2 * | 2/2003 | Zalkin et al. | 318/432 |
| 6,679,026 | B1 * | 1/2004 | Cirio | 53/317 |
| 6,874,301 | B2 * | 4/2005 | Kitamoto | 53/490 |
| 6,948,297 | B2 * | 9/2005 | Kitamoto | 53/490 |
| 7,024,837 | B2 * | 4/2006 | Takebe et al. | 53/490 |
| 7,204,066 | B2 * | 4/2007 | Monti | 53/287 |
| 7,299,602 | B2 * | 11/2007 | Denom et al. | 53/331 |
| 2006/0241807 | A1 | 10/2006 | Daniels et al. | |

FOREIGN PATENT DOCUMENTS

| | | | |
|---|---|---|---|
| EP | 0 467 091 | A1 | 1/1992 |
| EP | 0 618 168 | A1 | 10/1994 |

* cited by examiner

DEVICES AND METHODS FOR VERIFYING CAPPING OF VIALS IN SYSTEM FOR DISPENSING PRESCRIPTIONS

RELATED APPLICATION

This application claims priority from U.S. Provisional Patent Application No. 61/020,412, filed Jan. 11, 2008, the disclosure of which is hereby incorporated herein in its entirety.

FIELD OF THE INVENTION

The present invention is directed generally to the dispensing of prescriptions of pharmaceuticals, and more specifically is directed to the automated dispensing of pharmaceuticals.

BACKGROUND OF THE INVENTION

Pharmacy generally began with the compounding of medicines which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacist's tasks, automation of these tasks has been desirable.

Some attempts have been made to automate the pharmacy environment. Different exemplary approaches are shown in U.S. Pat. No. 5,337,919 to Spaulding et al. and U.S. Pat. Nos. 6,006,946; 6,036,812 and 6,176,392 to Williams et al. The Williams system conveys a bin with tablets to a counter and a vial to the counter. The counter dispenses tablets to the vial. Once the tablets have been dispensed, the system returns the bin to its original location and conveys the vial to an output device. Tablets may be counted and dispensed with any number of counting devices. Drawbacks to these systems typically include the relatively low speed at which prescriptions are filled and the absence in these systems of securing a closure (i.e., a lid) on the container after it is filled.

One additional automated system for dispensing pharmaceuticals is described in some detail in U.S. Pat. No. 6,971,541 to Williams et al. This system has the capacity to select an appropriate vial, label the vial, fill the vial with a desired quantity of a selected pharmaceutical tablet, apply a cap to the filled vial, and convey the labeled, filled, capped vial to an offloading station for retrieval.

Although this particular system can provide automated pharmaceutical dispensing, certain of the operations may be improved. For example, the reliability of the capping operation may be improved. Also, the ability to accommodate multiple styles and sizes of vials and caps with a single mechanism may also be desirable. One proposed vial capping station is described in U.S. patent application Ser. No. 11/679,850, filed Feb. 28, 2007, the disclosure of which is hereby incorporated herein by reference. The capping station described therein utilizes a rotating stage and an elevating cap capturing unit that centers both the cap and the vial, then attaches the cap by rotating the stage (on which the vial is grasped) relative to the cap.

One potential shortcoming of an automated capping station is the inability of such a station to recognize and alert the system to an uncapped or incorrectly capped vial. Thus, it may be desirable to provide an automated capping station with the capability of recognizing an uncapped or incorrectly capped vial.

SUMMARY OF THE INVENTION

As one aspect, embodiments of the present invention are directed to a method of verifying the seating of a twist-on closure on a container. The method comprises the steps of: positioning a container on a stage of an automated capping station; bringing a twist-on closure into contact with the container; detecting the nature of a physical relationship between the container and the closure; and, responsive to the detecting step, relatively rotating the closure and the container if the detecting step indicates seating of the closure on the container is proper. In some embodiments, the physical relationship is the height of the closure, which can help to indicate if the closure is properly seated.

As a second aspect, embodiments of the present invention are directed to a method of verifying the securing of a twist-on closure on a container. The method comprises the steps of: positioning a container on a stage of an automated capping station; bringing a twist-on closure into contact with the container; relatively rotating the closure and the container; and detecting the nature of a physical relationship between the closure and the container to determine whether the closure is properly secured. Exemplary physical relationships include the level of torque experienced by the vial and closure during rotation and the degree of rotation experienced during rotation.

As a third aspect, embodiments of the present invention are directed to a method of verifying the seating and securing of a twist-on closure on a container. The method comprises the steps of: (a) positioning a container on a stage of an automated capping station; (b) bringing a twist-on closure into contact with the container; (c) detecting the nature of a physical relationship between the container and the closure; (d) responsive to step (c), relatively rotating the closure and the container if step (c) indicates seating of the closure on the container is proper; and (e) detecting the nature of a physical relationship between the closure and the container to determine whether the closure is properly secured.

As a fourth aspect, embodiments of the present invention are directed to a method of verifying the seating of a closure on a container, comprising the steps of: positioning a container on a stage of an automated capping station; bringing a closure into contact with the container; detecting the nature of a physical relationship between the container and the closure; and responsive to the detecting step, relatively moving the closure and the container if the detecting step indicates seating of the closure on the container is proper.

DETAILED DESCRIPTION OF EMBODIMENTS OF THE INVENTION

Figure 1:
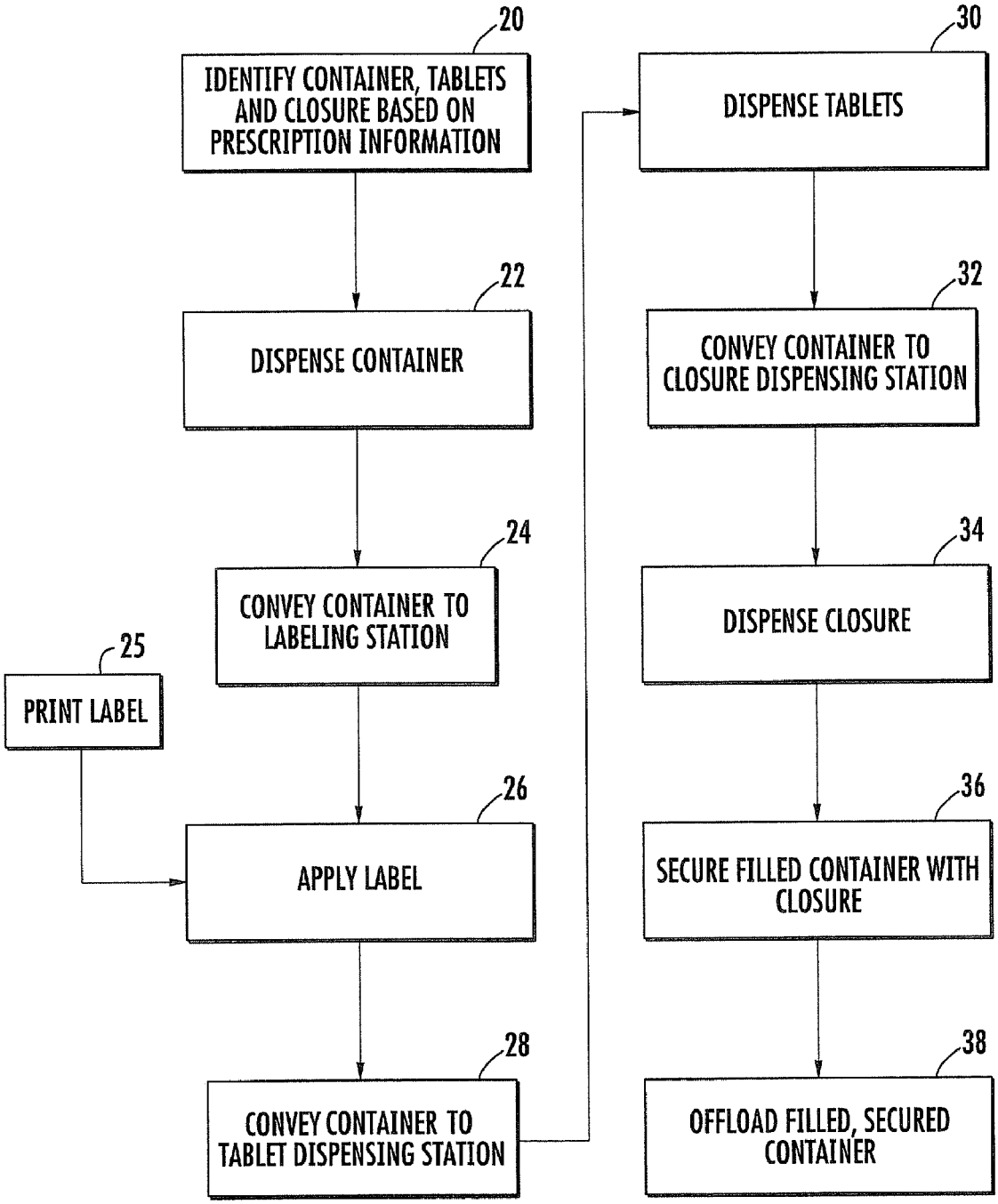
FIG. 1 is a flow chart illustrating an embodiment of a method according to the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As described above, the invention relates generally to a system and process for dispensing pharmaceuticals. An exemplary process is described generally with reference to FIG. 1. The process begins with the identification of the proper container, tablets or capsules and closure to be dispensed based on a patient's prescription information (Box 20). A container of the proper size is dispensed at a container dispensing station (Box 22), then moved to a labeling station (Box 24). A printing station prints a label (Box 25) that is applied at the labeling station (Box 26), after which the container is transferred to a tablet dispensing station (Box 28), from which the designated tablets are dispensed in the designated amount into the container (Box 30). The filled container is then moved to a closure dispensing station (Box 32), where a closure of the proper size has been dispensed (Box 34). The filled container is secured with a closure (Box 36), then transported to an offload station and offloaded (Box 38).

Figure 2:
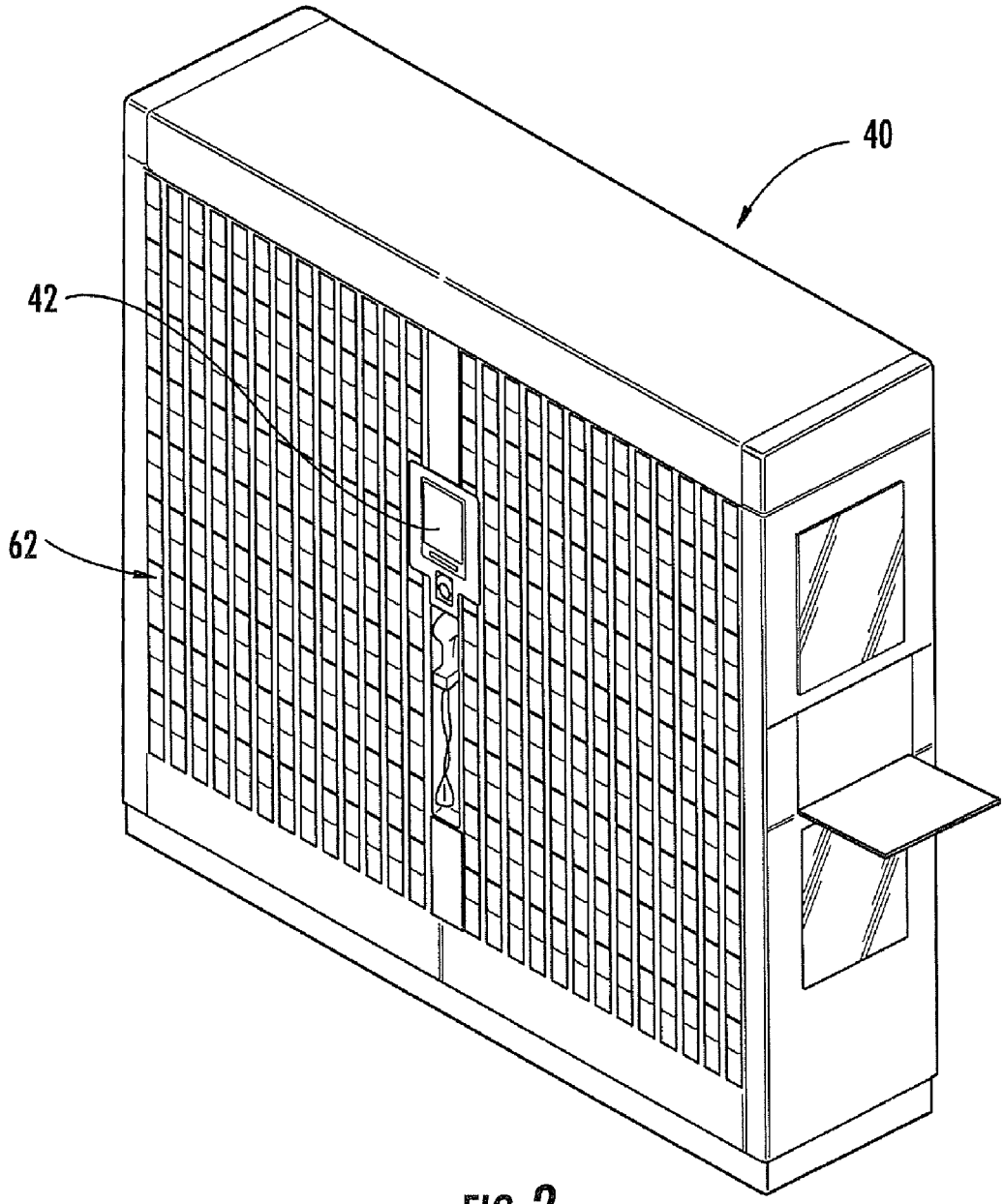
FIG. 2 is a perspective view of a pharmaceutical tablet dispensing system according to the present invention.
Figure 3:
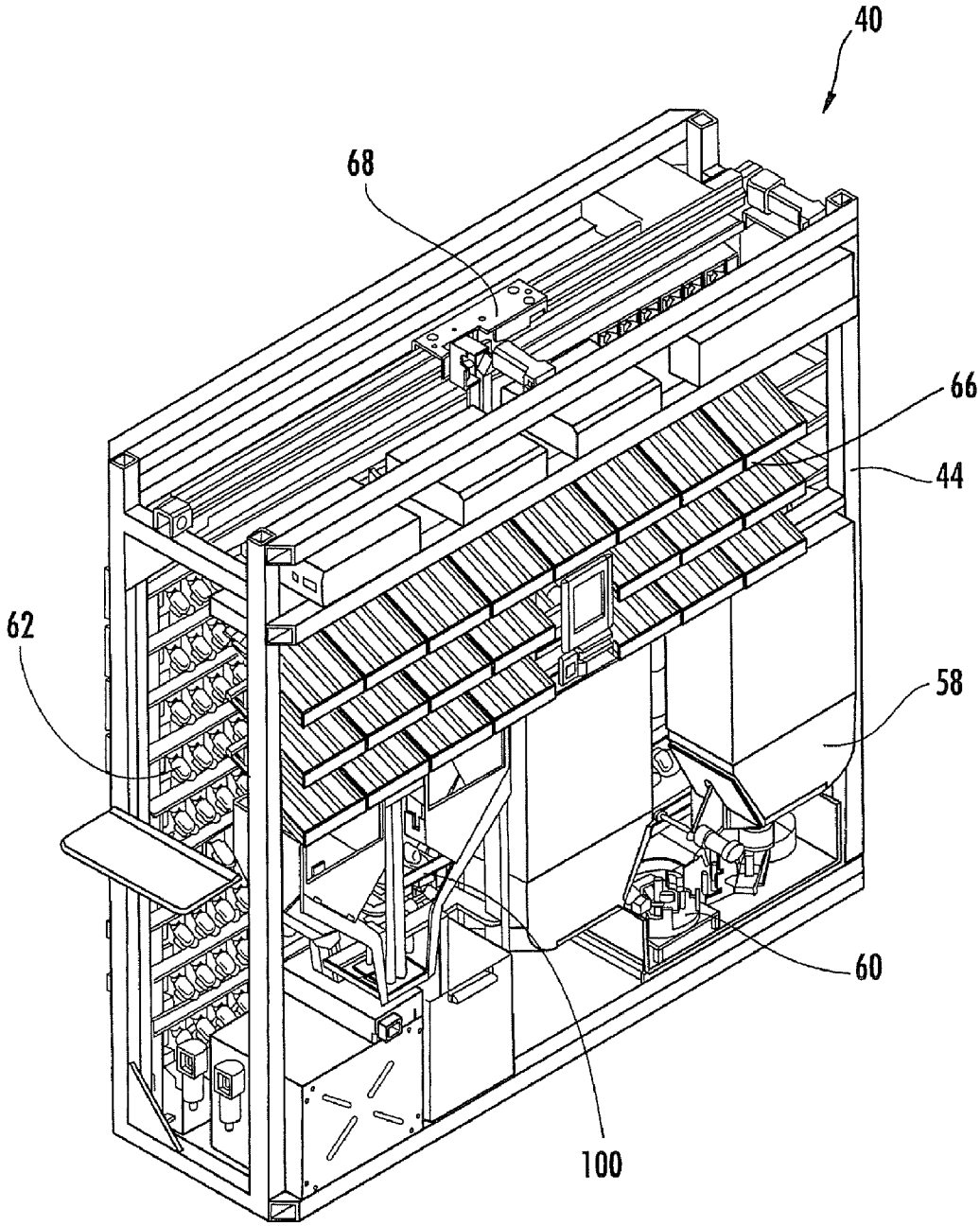
FIG. 3 is a cutaway view of the system of FIG. 2 illustrating the support frame, the container dispensing station, the carrier, and the closure dispensing station.

A system that can carry out this process is illustrated in FIGS. 2 and 3 and designated broadly therein at 40. The system 40 includes a support frame 44 for the mounting of its various components. The system 40 generally includes as operative stations a controller (represented herein by a graphics user interface monitor 42), a container dispensing station 58, a labeling station 60, a tablet dispensing station 62, a closure station 100, and an offloading station 66. In the illustrated embodiment, containers, tablets and closures are moved between these stations with a single carrier 68; however, in some embodiments additional carriers may be employed. With the exception of the closure station 100, which is described in detail below, each of the other operative stations and the conveying devices is described in detail in U.S. Pat. No. 6,971,541 to Williams et al., U.S. patent application Ser. Nos. 11/599,526; 11/599,576; 11/755,249; and U.S. Provisional Patent Application Ser. No. 60/938,869, the disclosures of each of which are hereby incorporated herein in its entirety.

Figure 4:
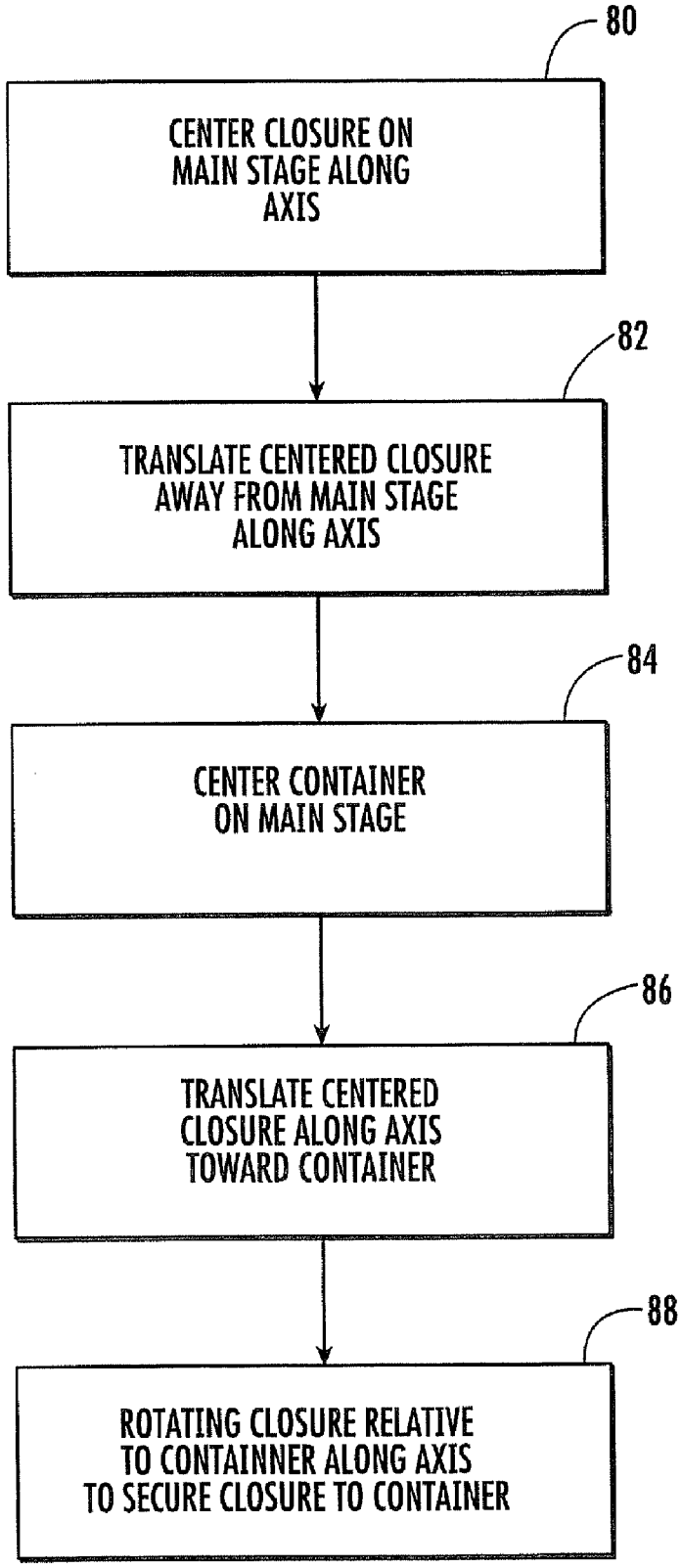
FIG. 4 is a flow chart illustrating an embodiment of a method of applying a closure to a filled vial according to embodiments of the present invention.

Referring now to FIG. 4, general operations of the closure station 100 are illustrated in the form of a flow chart. The closure station 100 can address situations that can arise with prior art systems in which a filled pharmaceutical vial may not be properly aligned with a cap or closure in order for the closure to be applied. According to embodiments of the present invention, a closure is centered along an axis at a first position (Block 80), then translated along that axis to a second position (Block 82). A filled vial or other container is then centered along the axis (Block 84). The centered closure is translated along the axis to a third position adjacent the container (Block 86), and the container is rotated relative to the closure about the axis to secure the closure to the container (Block 88). This method can assure that the closure and container are both centered about the same axis, which in turn can improve the reliability of the process of securing the closure onto the container.

Referring now to FIGS. 5-13, the structure and operation of the closure station 100 (which is capable of carrying out the method described in FIG. 4) is illustrated. A detailed explanation of the closure station 100 is set forth in U.S. patent application Ser. No. 11/679,850, supra; its general operation is set forth below.

Figure 5:
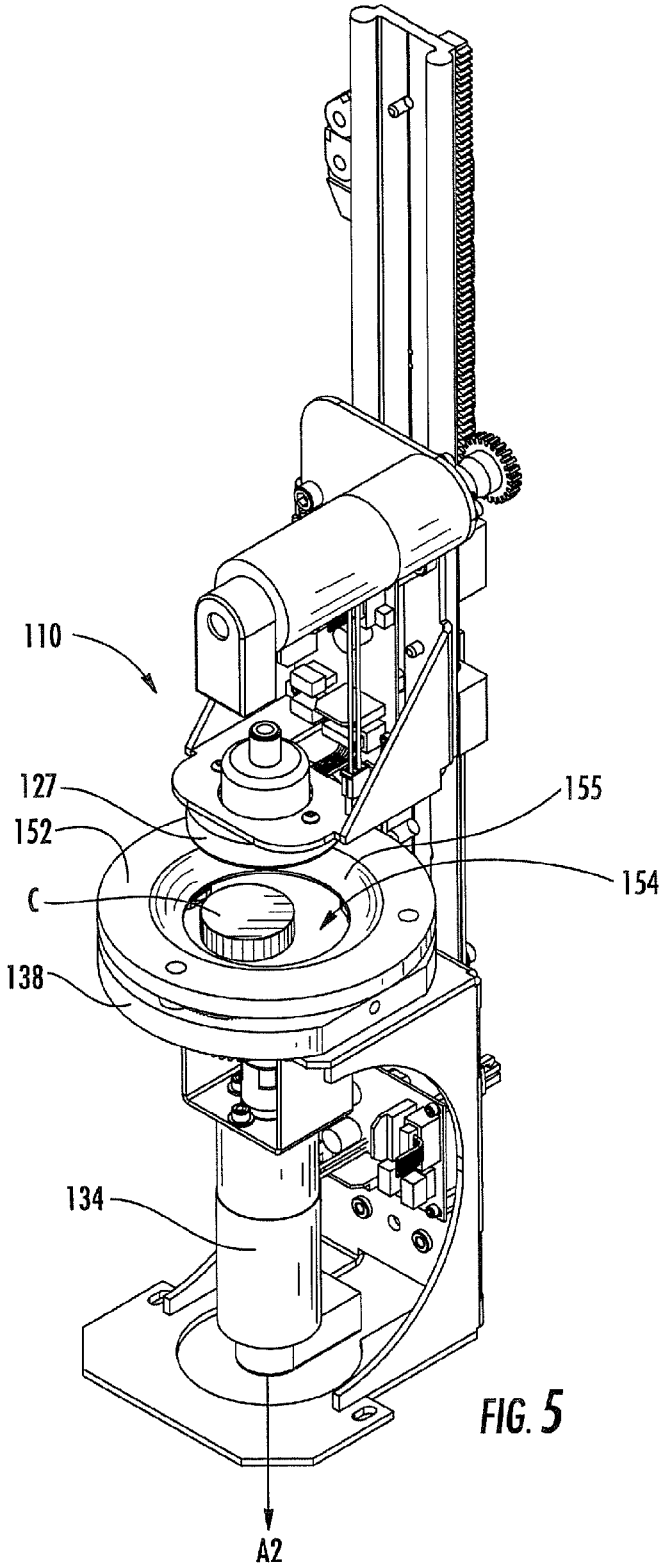
FIG. 5 is a perspective view of the closure station of the system of FIGS. 2 and 3 showing the reception of a closure, with the elevator in an intermediate position.

As shown in FIG. 5, the closure station 100 can begin in an intermediate position, in which a suction pad (not visible herein) or another securing component located beneath a suction block 127 of an elevator 110 is located just above an upper stage 152. In this position, the closure station 100 is free to receive a closure (i.e., a cap for a vial) from, for example, a closure dispensing station similar to that shown in U.S. Pat. No. 6,971,541 to Williams et al., or one similar to that shown in co-pending and co-assigned U.S. patent application Ser. No. 11/693,929, filed Mar. 30, 2007. In some embodiments, the closure is automatically dispensed and travels down a chute (not shown) to the closure station 100. The gap between the suction pad and the upper stage 152 is such that a closure can enter the upper stage 152, but cannot escape.

As shown in FIG. 5, upon arriving at the closure station 100, the closure C is received in the aperture 154 of the upper stage 152. The sloping surfaces 155 of the upper stage 152 assist in guiding the closure C as it exits the chute and urge the closure C to come to rest in the aperture 154.

Figure 6:
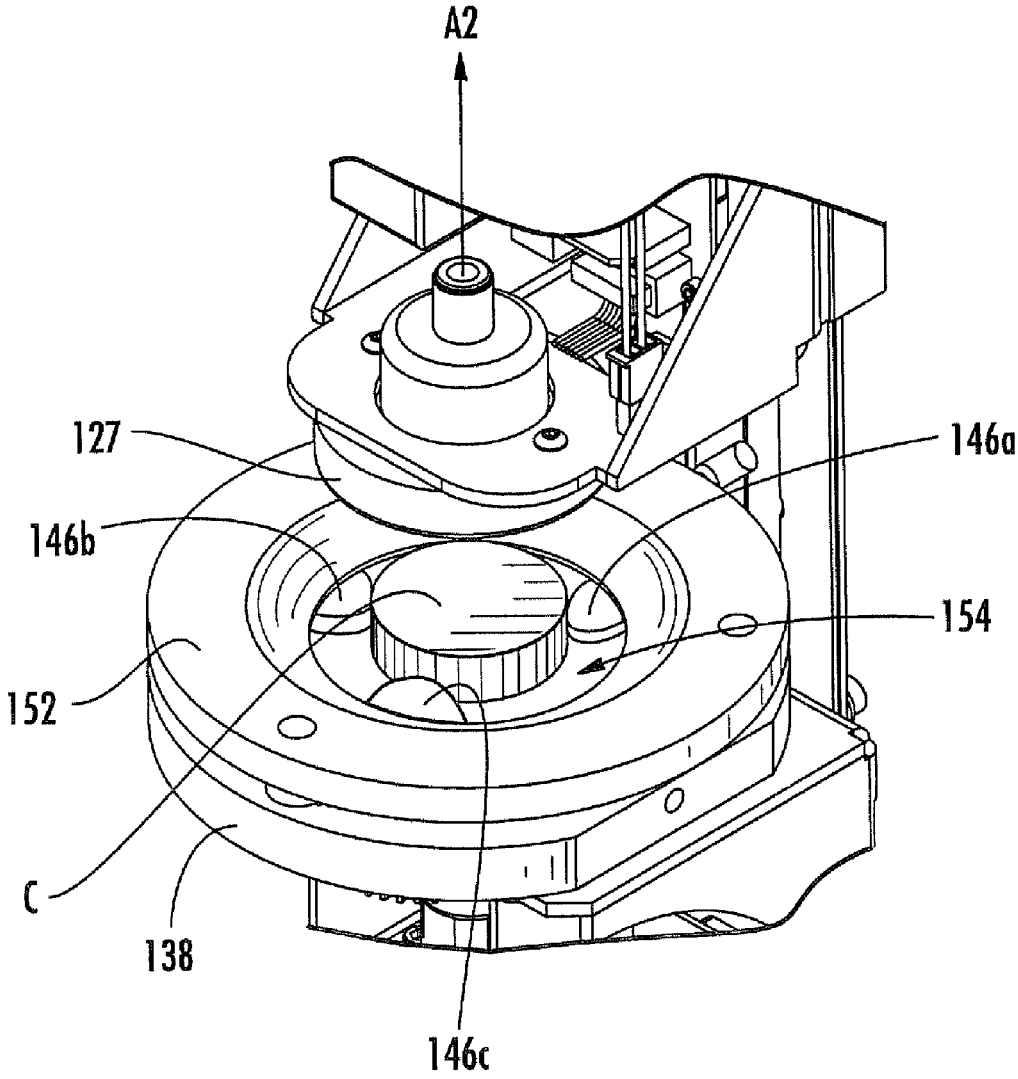
FIG. 6 is an enlarged perspective view of the closure station of FIG. 5 showing the centering of a closure.

Once the closure C has been deposited in the aperture 154 (the presence of the closure C can be determined in different ways, such as detection by a sensor located in a closure delivery chute, the passage of a predetermined period of time, or the like), the controller 42 signals a drive motor 134 to rotate the main stage 138 counterclockwise (from the vantage point of FIG. 5) about an axis A2. Rotation of the main stage 138 causes, through an intervening clutch mechanism and gear assembly, clamps 146*a*, 146*b*, 146*c* (shown in FIG. 6) to rotate counterclockwise so that they extend out from under the upper stage 152 and their arcuate edges face inwardly toward axis A2. Rotation ceases after each of the clamps 146*a*, 146*b*, 146*c* has contacted the closure C; this can be determined based on a predetermined time period, a torque or position sensor, or the like. At this point the closure C should be centered in the aperture 154 (FIG. 6).

Figure 7:
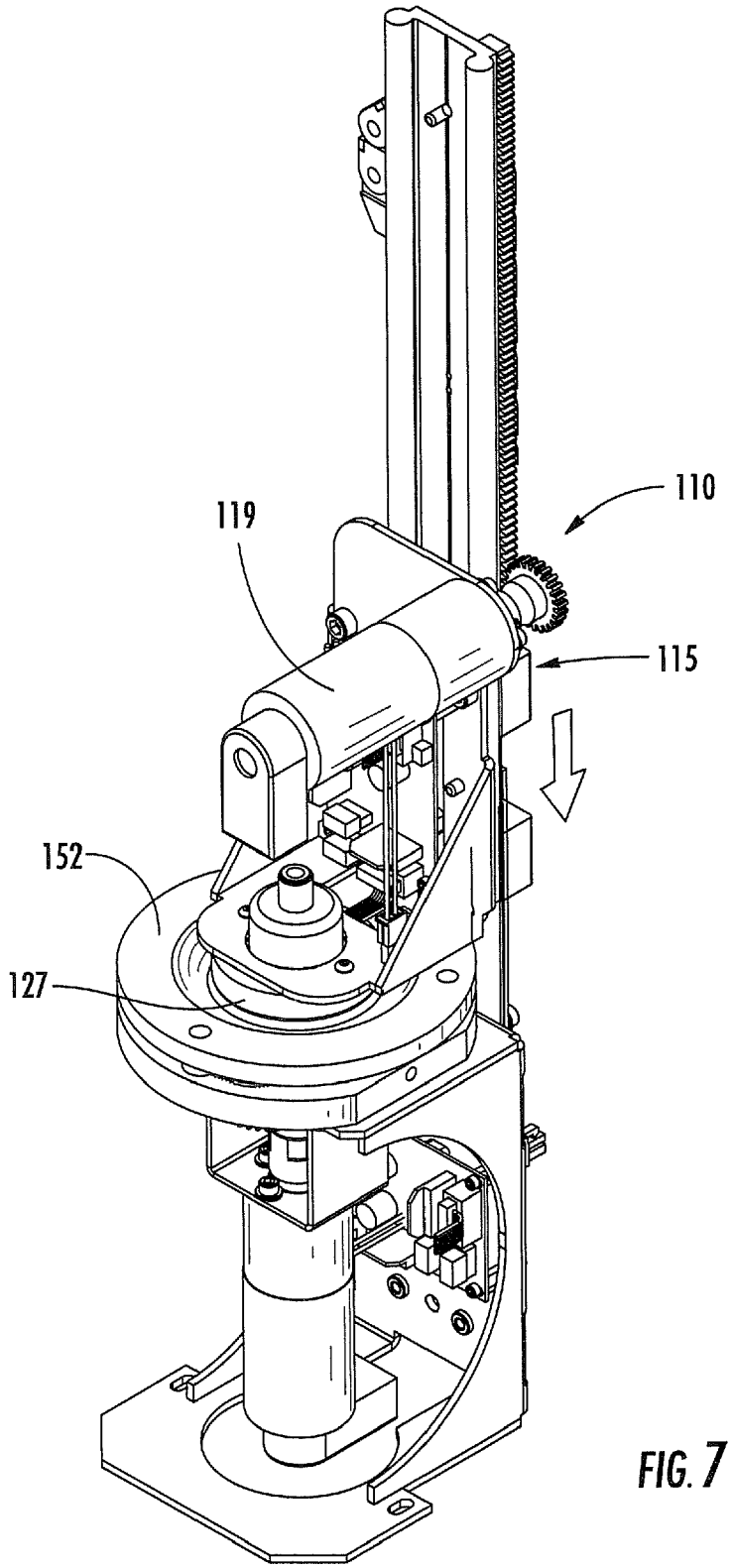
FIG. 7 is a perspective view of the closure station of FIG. 5 showing the elevator capturing the closure.

Once the closure C is centered and rotation of the main stage 138 ceases, the controller 42 actuates an elevator mechanism 115 to drive the elevator 110 downward (FIG. 7). The elevator 110 ceases its downward movement when the suction cup positioned beneath suction block 127 contacts the closure C (movement of the elevator 110 ceases responsive to position sensors, force sensors, or the like). At this point the controller 42 signals the suction source to apply suction to the suction cup, thereby attaching the closure C thereto.

Figure 8:
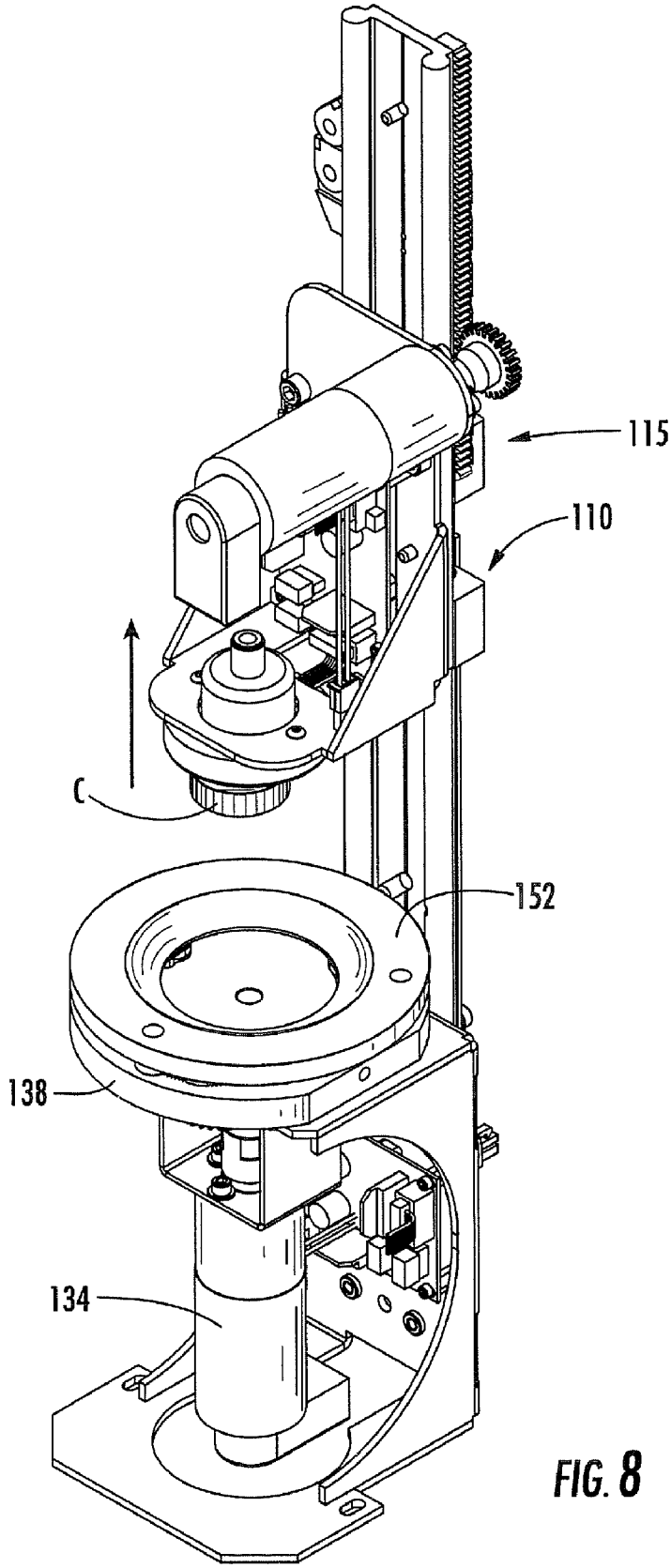
FIG. 8 is a perspective view of the closure station of FIG. 5 showing the elevator and closure in a raised position.

After the closure C is attached to the suction cup (this can be verified with a vacuum contact switch or the like), the controller 42 activates the elevator mechanism 115 to raise the elevator 110, thereby translating the closure C along the axis A2 to a raised position (FIG. 8). In addition, the controller 42 signals the drive motor 134 to reverse direction, which action rotates the clamps 146*a*, 146*b*, 146*c* slightly clockwise toward their original positions to release the substantially centered closure C (FIG. 8).

Figure 9:
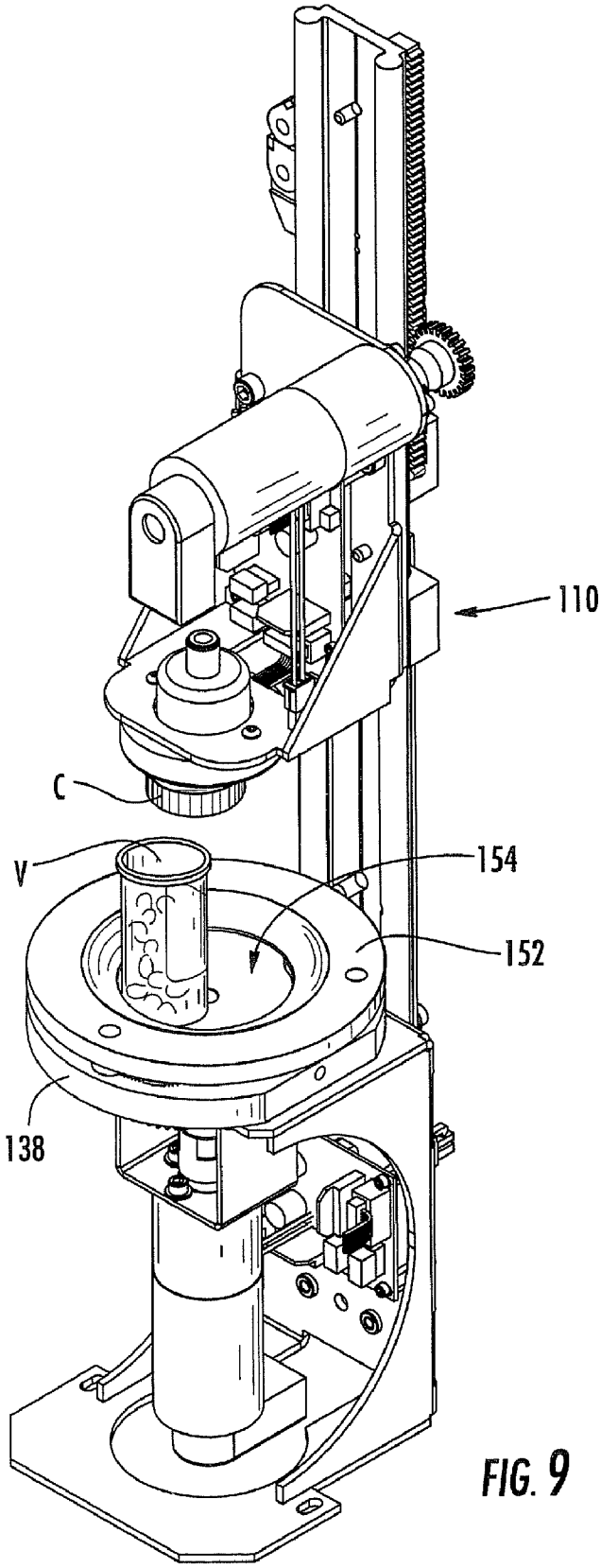
FIG. 9 is a perspective view of the closure station of FIG. 5 showing the receipt of a filled vial on the main stage.
Figure 10:
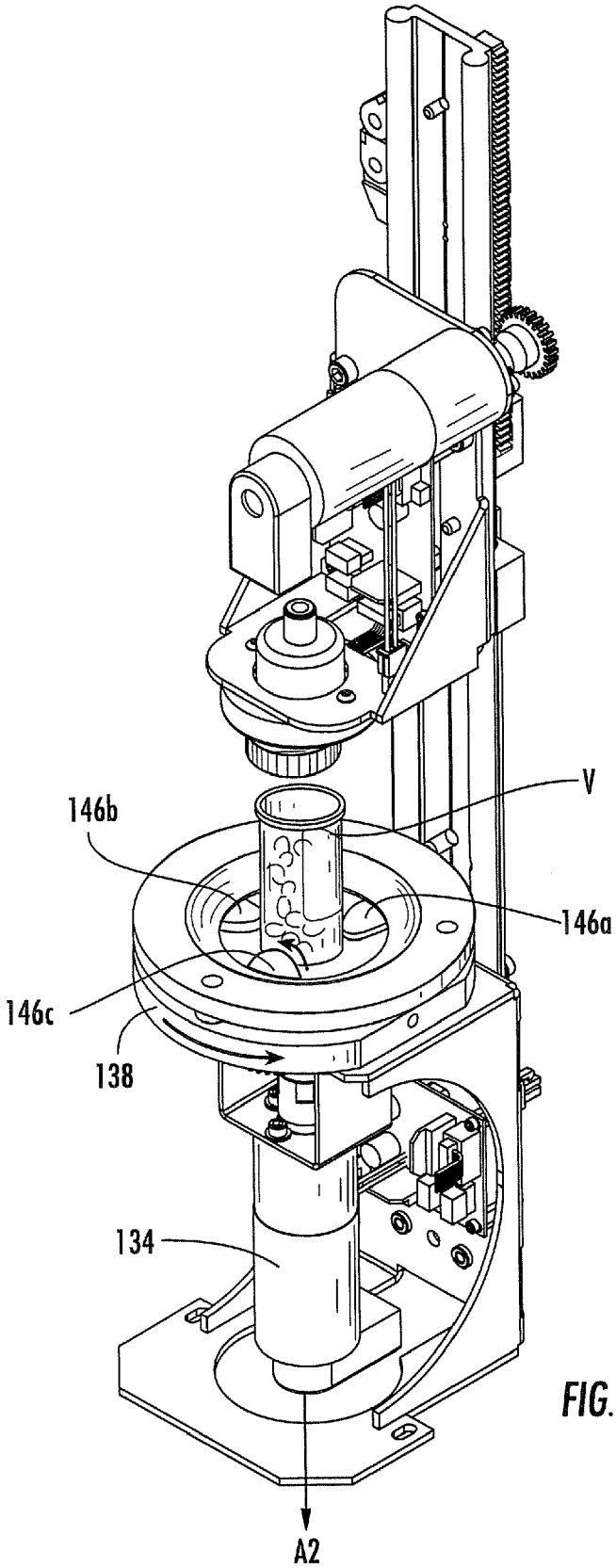
FIG. 10 is a perspective view of the closure station of FIG. 5 showing the operating of the clamps to center the filled vial.

When the elevator 110 has completed its ascension (FIG. 8), having translated the closure C along the axis A2 while maintaining it in a centered condition, the closure station 100 is then free to receive a filled vial V from the carrier 68. The carrier 68 conveys the filled vial V to the aperture 154 of the upper stage 152, deposits it there, and withdraws (FIG. 9). The controller 42 then signals the drive motor 134 to rotate the main stage 138 counterclockwise. As described above, this rotation rotates the clamps 146*a*, 146*b*, 146*c* counterclockwise such that they contact and substantially center the lower end of the filled vial V (FIG. 10). As a result, both the closure C and the filled vial V are substantially centered by the same components. This should register the closure C and the filled vial V along the axis A2 for subsequent securing of the closure C on the filled vial V.

Figure 11:
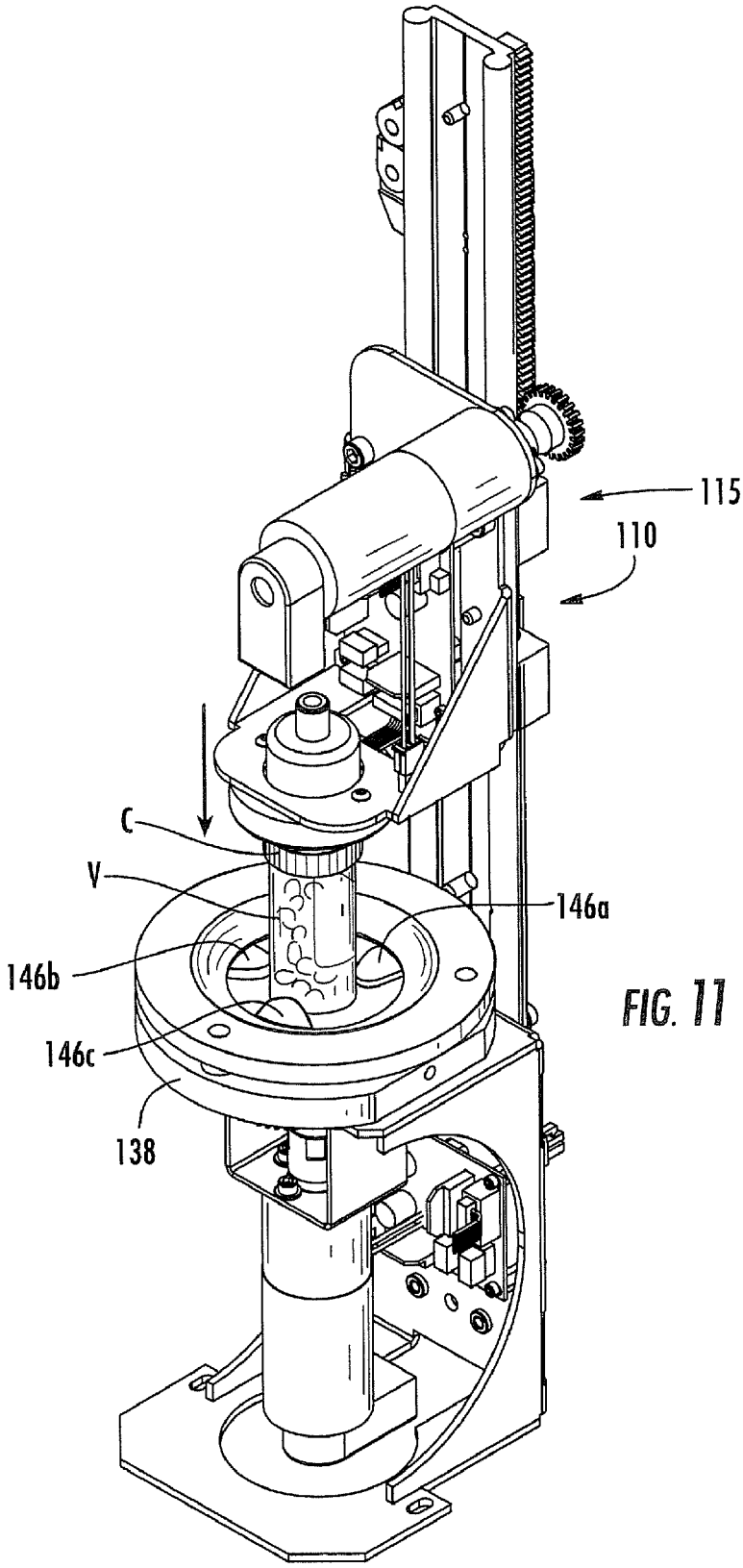
FIG. 11 is a perspective view of the closure station of FIG. 5 showing the lowering of the elevator to deposit the closure on the filled vial.
Figure 12:
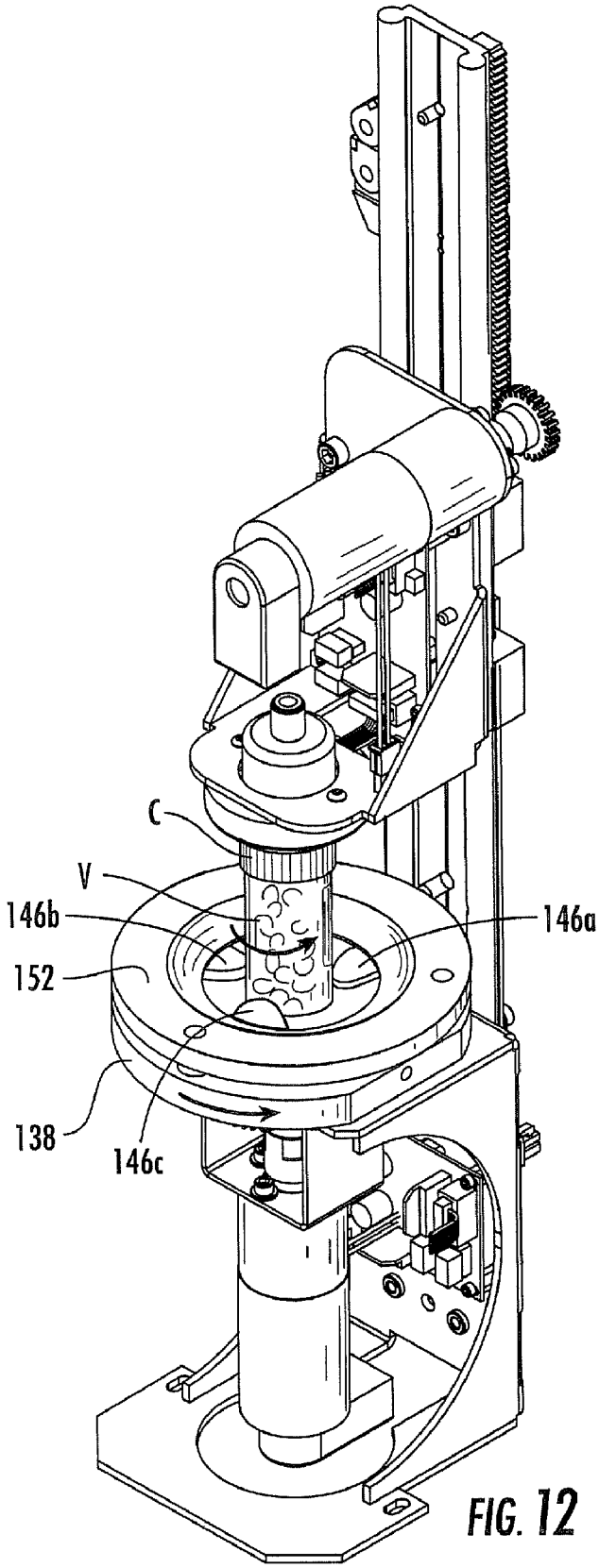
FIG. 12 is a perspective view of the closure station of FIG. 5 showing the rotation of the main stage to secure the closure to the filled vial.
Figure 13:
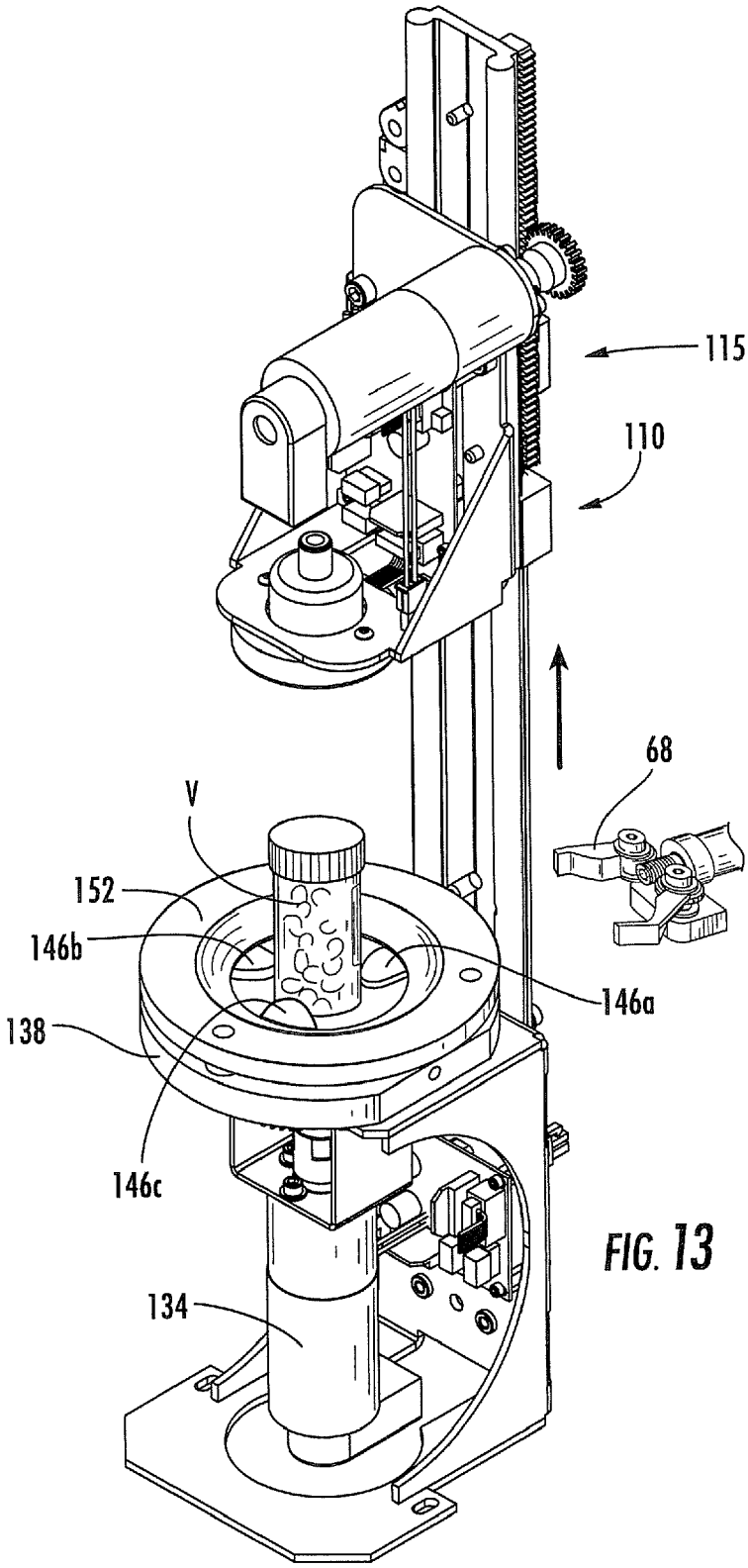
FIG. 13 is a perspective view of the closure station of FIG. 5 showing the elevator in the raised position and the dispensing carrier retrieving the filled, capped vial from the closure station.

At the same time, the controller 42 activates the elevator mechanism 115 to lower the elevator 110 and translate the closure C along the axis A2 until the closure C is in position just above the top of the filled vial V (FIG. 11). The main stage 138 continues to rotate, and the elevator 110 descends until the closure C encloses the perimeter of the upper edge of the filled vial V (movement of the elevator 110 continues responsive to position sensors, force sensors, or a combination thereof). The elevator 110 maintains a downwardly-directed force to urge the closure C against the upper edge of the vial V.

Once the closure C is in position for securing, the main stage 138 continues its counterclockwise rotation (with the closure C remaining stationary due to friction between it and the suction cup 128). Because the clamps 146*a*, 146*b*, 146*c* are clamped against the vial V, they are prevented from further counterclockwise rotation. The aforementioned gear assembly and clutch enable the main stage 138 (and the vial V clamped thereon) to continue to rotate counterclockwise. This counterclockwise rotation of the vial V relative to the stationary closure C twists the closure C onto the vial V (see FIG. 12). Rotation can be halted based on a predetermined time period, a position sensor, a torque sensor, or the like.

Once securing of the closure C is complete, the controller 42 signals the suction source to deactivate, activates the elevator assembly 115 to raise the elevator 110, and activates the drive motor 134 to rotate the main stage clockwise to release the clamps 146*a*, 146*b*, 146*c* from the now-capped filled vial V. The controller 42 then signals the carrier 68 (FIG. 13) to retrieve the capped, filled vial V for subsequent operations (such as offloading).

Figure 14:
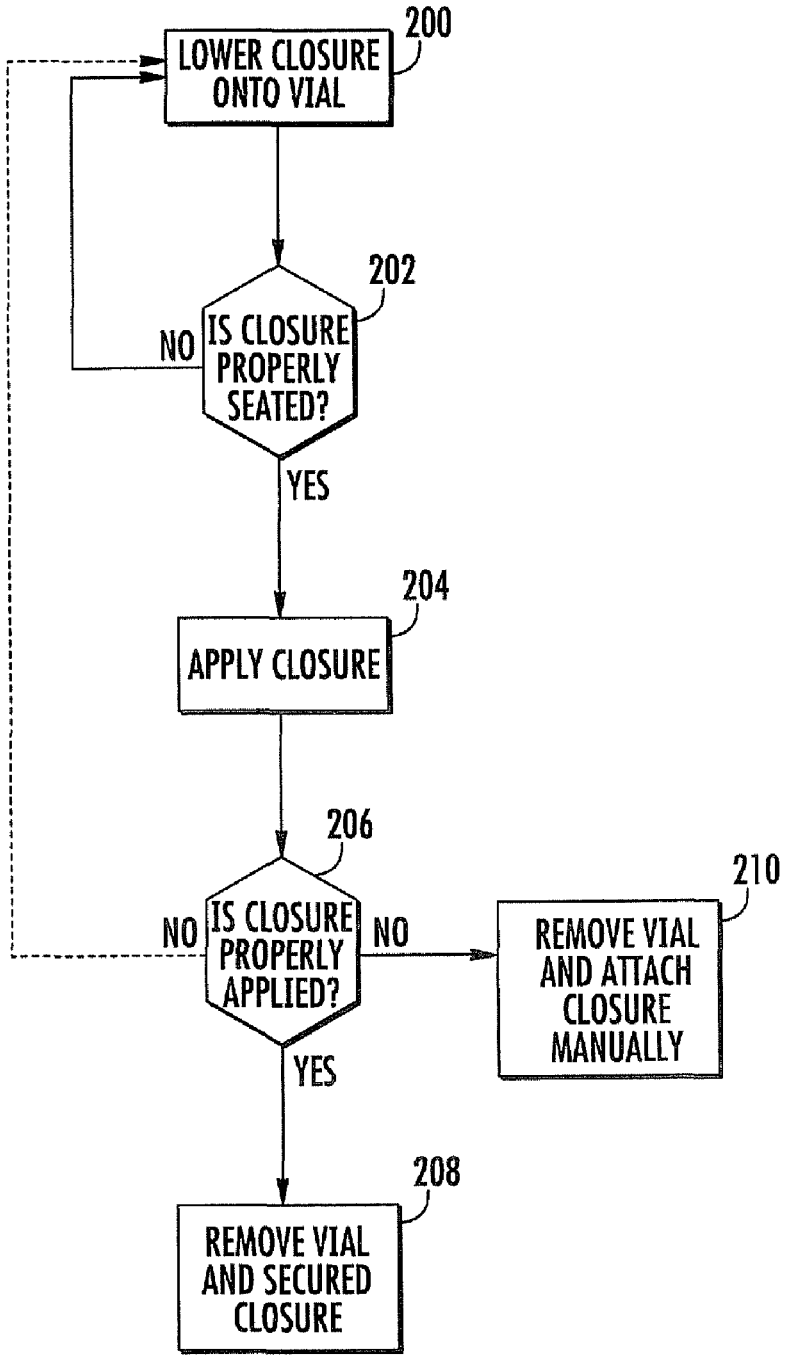
FIG. 14 is a flow chart illustrating operations of the capping station of FIG. 5 to verify that a cap is properly seated on a vial.
Figure 15A:
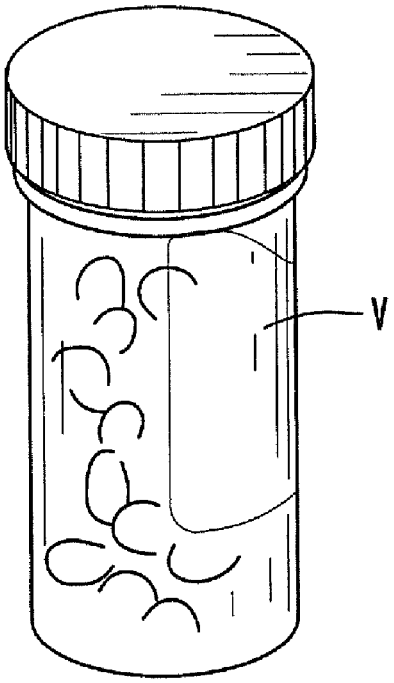
FIG. 15A is a side view of a vial with a properly seated cap.
Figure 15B:
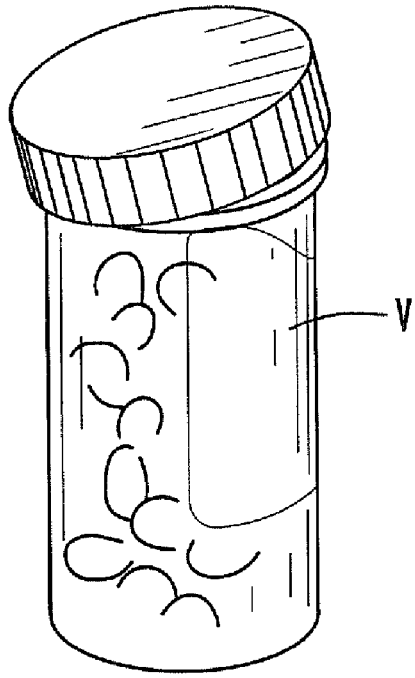
FIG. 15B is a side view of a vial with an improperly seated cap.

Turning now to FIG. 14, a flow chart illustrating operations for the verification of the application of a closure to a vial are shown therein. Initially, the closure is positioned on the top edge of the vial (Box 200). This step can be carried out by, for example, lowering the elevator 110 so that the closure C is positioned atop the vial V as shown in FIG. 11. Because both the vial V and the closure C are centered along the axis A2, in most cases the closure C and vial V should be positioned relative to each other such that the vial seats properly (see FIG. 15A). However, in some instances the closure C may not seat properly (see FIG. 15B). Thus, the system 40 may determine, from the vertical position of the elevator 110, whether the closure C is properly seated (Box 202).

In some embodiments of the invention, the closure station 100 may include a unit for sensing the elevation of the closure C once it has moved onto the top of the vial V (as described above in connection with FIGS. 11 and 12). Typically, an unseated cap will rest on the top of the vial V at a greater height than will a seated cap (compare, for example, FIGS. 15A and 15B). Thus, a unit that can detect the height of the closure C on the vial V can determine whether the cap is properly seated.

In one embodiment, a sensor can be associated with the elevator mechanism 115, which determines the height of the suction cap as it descends with the closure C onto the vial V. For example, as the elevator 110 descends with the closure C, it may press the closure C onto the vial V, and the height of the elevator 110 may be determined at the lowest point during this step. As an alternative, the system may detect the height of the elevator 110 at a known force, which would also be indicative of the state of the closure C relative to the vial V. If the closure C is misaligned, the height recorded for the elevator 110 will exceed a predetermined range for an aligned closure C. If the vial V has tipped over or is absent, the height of the elevator 110 will be lower than the predetermined range. Thus, if the system 40 detects that this height is outside of the predetermined range, the system 40 can issue an alert to enable a technician to address the problem. In some embodiments, a misaligned or unseated closure C may simply be recentered and reapplied in the manner described above; in some instances, the vial V may be rotated slightly in an effort to reseat the closure C properly.

Those skilled in this art will appreciate that the height of the closure C may be determined in any manner suitable for measuring the height of an object. For example, the elevator mechanism 115 may include a motor that employs an encoder value homed to a sensor at the bottom of the elevator mechanism 115. Alternatively, any type of position feedback sensor, such as a potentiometer or binary sensor, may also be used. Other alternatives will also be known to those skilled in this art.

Moreover, in other embodiments another physical relationship between the closure C and the vial V may be assessed. For example, the angle of the closure C as it rests on the vial V may be determined, with an angle greater than a certain predetermined angle signifying an unseated closure C.

It should be noted that, although this technique has been illustrated in connection with a twist-on closure, it may also be suitable for use with a snap-on closure, wherein the container and the closure are moved relative to each other (i.e., snapped on) if the initial seating verification step shows proper seating of the closure in the container.

Returning to FIG. 14, after the sensing of the closure alignment, the system 40 may then attempt to apply the closure C to the vial V in the manner discussed above (Box 204). Of course, in some embodiments, relative rotation of the closure C and vial V may be achieved by rotating the closure C and maintaining the vial V in a stationary position.

As the closure C is being applied, the system 40 may determine whether the closure C has been properly secured (Box 206). Such a unit may monitor the magnitude of torque required to apply the closure C. In a typical securing step, as the vial V is rotated relative to the closure C, the torque required for rotation is relatively low. Once the closure C is fully secured, the torque required for rotation "spikes" significantly. In contrast, a closure C that is not secured will not experience a torque spike. Thus, monitoring the torque level on the drive motor 134 for the main stage 138 can determine whether the cap is secured correctly. Those skilled in this art will appreciate that any number of techniques for measuring the torque of the drive motor 134 may be used, including a conventional torque sensor, the monitoring of current motor draw, or the like.

Figure 16A:
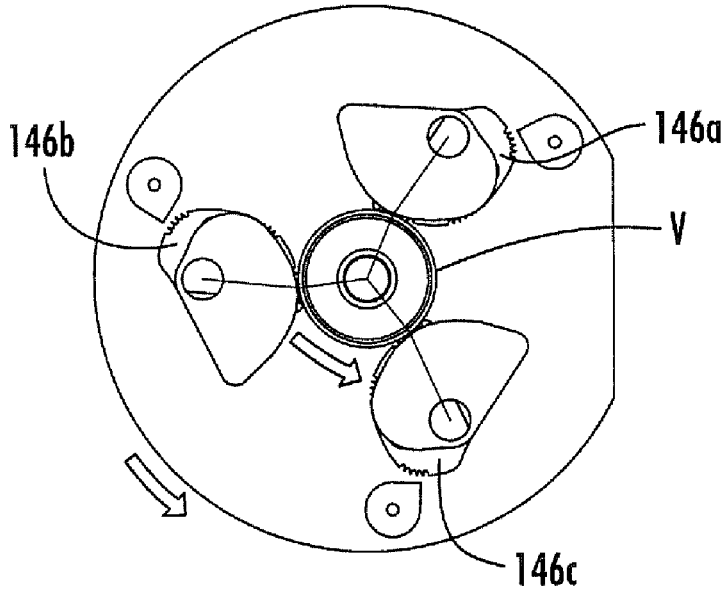
FIG. 16A is a top view of the closure station of FIG. 5 with the upper stage removed and showing the main stage in a first rotative position.
Figure 16B:
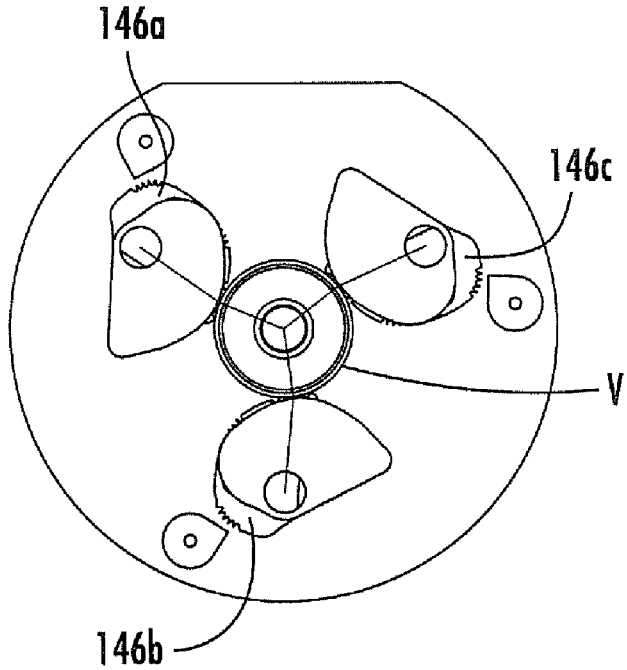
FIG. 16B is a top view of the closure station of FIG. 5 with the upper stage removed showing the main stage in a second rotative position.

As an alternative, the system 40 may monitor the position of the main stage 138. As discussed above, the main stage 138 rotates (with the vial V clamped by the clamps 146*a*, 146*b*, 146*c*—see FIG. 16A) as the closure C remains stationary. Once the closure C is completely secured (i.e., it reaches the ends of its threads), the main stage 138 is no longer able to rotate (FIG. 16B). In contrast, with an unsecured closure C, the main stage 138 continues to rotate. Thus, monitoring the magnitude of rotation of the main stage 138 can determine whether the closure C is secured correctly. Those skilled in this art will appreciate that any number of techniques for measuring the position of the main stage 138, including measuring position feedback from the drive motor 134, may be employed.

It may also be possible for an improperly seated closure C to "lock" into place, such that relative rotation between the closure C and the vial V is inhibited. In such an instance, the magnitude of the relative angular rotation of the vial V and the closure C would be less than a predetermined threshold.

In other embodiments, another physical relationship between the closure C and the vial V (for example, the change in height of the closure C during the application process) may also be employed to determine proper securing of the closure C.

If the vial V is properly capped, it may be removed from the closure station 100 (Box 208), typically by the carrier 68, once the clamps 146*a*, 146*b*, 146*c* have been released. If the vial V is not securely capped, it can be removed and capped manually (Box 210), or in some embodiments the controller 42 may attempt to re-seat and re-secure the closure C in the manner described above.

As shown in FIG. 14, closure verification may utilize multiple steps and techniques. In the illustrated embodiment, both closure seating and closure securing are employed. However, in other embodiments, only one of these techniques may be employed.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

What is claimed is:

1. A method of verifying the securing of a twist-on closure on a container, comprising the steps of:

positioning a container on a stage of an automated capping station;

bringing a twist-on closure into contact with the container;

relatively rotating the closure and the container; and detecting the nature of a physical relationship between the closure and the container to determine whether the closure is properly secured;

wherein the detecting step comprises monitoring relative angular rotation of the container during the rotating step, wherein angular rotation outside a predetermined threshold range indicates an improperly secured cap; and wherein the rotating step comprises maintaining the closure in a stationary position as the container is rotated.

2. The method defined in claim 1, wherein the detecting step comprises detecting a torque spike during the rotating step, the torque spike being indicative of a properly secured cap.

3. The method defined in claim 1, wherein the rotating step comprises rotating the stage, and wherein the detecting step comprises monitoring the angular rotation of the stage.

4. The method defined in claim 1, wherein the container is a pharmaceutical vial.

5. A method of verifying the seating and securing of a twist-on closure on a container, comprising the steps of:

(a) positioning a container on a stage of an automated capping station;

(b) bringing a twist-on closure into contact with the container;

(c) detecting the height of the closure as it rests on the container;

(d) responsive to step (c), relatively rotating the closure and the container if step (c) indicates seating of the closure on the container is proper; and (e) detecting the nature of a physical relationship between the closure and the container to determine whether the closure is properly secured.

6. The method defined in claim 5, wherein the bringing step comprises lowering the closure onto the container with an elevator prior to the detecting step, and wherein step (c) comprises contacting the closure with the elevator container.

7. The method defined in claim 6, wherein the elevator includes a securing component, and wherein the rotating step comprises maintaining the closure in a stationary position as the container is rotated.

8. The method defined in claim 6, wherein step (c) comprises detecting the height of the elevator as the container is in contact with the closure.

9. The method defined in claim 5, wherein step (e) comprises detecting a torque spike during the rotating step, the torque spike being indicative of a properly secured cap.

10. The method defined in claim 5, wherein step (e) comprises monitoring relative angular rotation of the container during the rotating step, wherein angular rotation outside a predetermined threshold range indicates an improperly secured cap.

11. The method defined in claim 10, wherein the rotating step comprises maintaining the closure in a stationary position as the container is rotated.

12. The method defined in claim 11, wherein the rotating step comprises rotating the stage, and wherein the detecting step comprises monitoring the angular rotation of the stage.

13. The method defined in claim 5, wherein the container is a pharmaceutical vial.

14. The method defined in claim 5, further comprising the step of adjusting the closure relative to the container if step (c) indicates that the closure is not properly seated.

15. A method of verifying the seating and securing of a twist-on closure on a container, comprising the steps of:

(a) positioning a container on a stage of an automated capping station;

(b) bringing a twist-on closure into contact with the container;

(c) detecting the nature of a physical relationship between the container and the closure;

(d) responsive to step (c), relatively rotating the closure and the container if step (c) indicates seating of the closure on the container is proper; and (e) detecting the nature of a physical relationship between the closure and the container to determine whether the closure is properly secured;

further comprising the step of adjusting the closure relative to the container if step (c) indicates that the closure is not properly seated.

16. A method of verifying the securing of a twist-on closure on a container, comprising the steps of:

positioning a container on a stage of an automated capping station;

bringing a twist-on closure into contact with the container;

relatively rotating the closure and the container; and detecting the nature of a physical relationship between the closure and the container to determine whether the closure is properly secured;

wherein the rotating step comprises maintaining the closure in a stationary position as the container is rotated.

* * * * *